United States Patent [19]

Bartels

[11] 4,351,067

[45] Sep. 28, 1982

[54] WORK GLOVES WITH ATTACHMENT MECHANISM

[76] Inventor: Franklin D. Bartels, 495 E. Gail, Tulare, Calif. 93274

[21] Appl. No.: 251,349

[22] Filed: Apr. 6, 1981

[51] Int. Cl.[3] ..... A41D 19/00

[52] U.S. Cl. ..... 2/160; 2/161 R

[58] Field of Search ..... 2/161 R, 162, 159, 160, 2/158, 323, DIG. 6

[56] References Cited

U.S. PATENT DOCUMENTS

| | | | |
|---|---|---|---|
| 2,710,409 | 6/1955 | Burandt | 2/160 |
| 2,717,437 | 9/1955 | Demestral | 2/DIG. 6 |
| 3,196,511 | 7/1965 | Kintner | 2/323 X |

*Primary Examiner*—Richard J. Scanlan, Jr.
*Attorney, Agent, or Firm*—Brown & Martin

[57] ABSTRACT

A pair of work gloves are provided with a special attachment mechanism which permits them to be removably attached to a workman's belt or releasably connected to one another. A strip is connected to the cuff of each of the gloves. A pair of mating hook weave connecting surfaces are secured to opposite ends of the strip. The strip may be encircled around the workman's belt and the hook weave connecting surfaces pressed together so that the glove will be removably attached to the belt. Each strip further has a third hook weave connecting surface secured thereto. The third surfaces of a pair of similar gloves are adapted to mate with each other to removably connect the gloves together. The mating hook weave connecting surfaces are dimensioned so that the gloves can be disconnected from one another and the hook weave surfaces that hold each of the strips in a loop configuration will not become disconnected.

2 Claims, 5 Drawing Figures

WORK GLOVES WITH ATTACHMENT MECHANISM

BACKGROUND OF THE INVENTION

The present invention relates to workman's gloves, and more particularly, to a pair of gloves provided with a special attachment mechanism which permits them to be removably attached to a workman's belt or releasably connected to one another.

In many occupations which involve heavy manual labor, it is necessary for individuals to wear gloves to protect their hands from abrasion, splinters, and blistering. For example, many workmen in plywood mills wear heavy leather gloves when stacking and loading veneer. In such occupations, individuals frequently take their gloves off numerous times during the day to perform other duties which require increased dexterity and less protection, for example, writing of reports and orders. All too often the gloves are misplaced by laying them down at a location which is later forgotten. Frequently, a person performs a heavy manual task without gloves after failing to locate the same. Thus, wear and tear on the hands is unnecessarily increased. Furthermore, valuable work time is lost if an individual stores the gloves at some location from which they must be retrieved and replaced after each use.

In some instances, it is desirable to be able to carry several hand tools around the work area. Storing screwdrivers, pliers and the like in pants pockets is undesirable because they are not easily reached and sitting is made uncomfortable. Storing the tools in shirt pockets is undesirable since they tend to fall out when a person bends over. Most belts specifically provided with tool receptacles are too bulky and heavy for merely carrying a few tools.

SUMMARY OF THE INVENTION

Accordingly, it is a primary object of the present invention to provide a pair of gloves with an attachment mechanism which permits the gloves to be removably attached to a workman's belt on an individual basis.

It is a further object of the present invention to provide a pair of gloves with an attachment mechanism which permits the gloves to be releasably connected to one another so that the gloves can be hung over fences, ladders, pipes and the like near the work area.

Still another object of the present invention is to provide a pair of work gloves each having a large cuff and loop having a free end which may be encircled around a workman's belt and reattached to the glove so that a plurality of tools can be placed inside the glove in the manner of a tool pouch.

It is still a further object of the present invention to provide a pair of gloves, each having a strip with one end sewn to the cuff portion of the glove and another end releasably attachable to the glove with hook weave mating connecting surfaces so that the gloves may be removably attached to a workman's belt.

Yet another object of the present invention is to provide a pair of gloves of the aforementioned type which are provided with additional hook weave mating connecting surfaces which are sized so that the gloves may be connected to one another while permitting the gloves to be pulled apart without disconnecting the loops from their corresponding gloves.

The present invention provides a pair of work gloves provided with a special attachment mechanism which permits them to be removably attached to a workman's belt or releasably connected to one another. A strip is connected to the cuff of each of the gloves. A pair of mating hook weave connecting surfaces are secured to opposite ends of the strip. The strip may be encircled around the workman's belt and the hook weave connecting surfaces pressed together so that the glove will be removably attached to the belt. Each strip further has a third hook weave connecting surface secured thereto. The third surfaces of a pair of similar gloves are adapted to mate with each other to removably connect the gloves together. The mating hook weave connecting surfaces are dimensioned so that the gloves can be disconnected from one another and the hook weave surfaces that hold each of the strips in a loop configuration will not become disconnected.

DESCRIPTION OF THE PREFERRED EMBODIMENT

Figure 1:
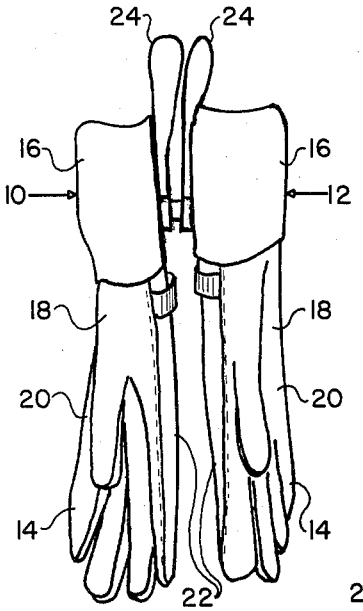
FIG. 1 depicts a pair of work gloves constructed in accordance with the present invention so that they can be releasably connected together at their cuffs.

Referring to FIG. 1, the illustrated embodiment of my invention is incorporated into a conventional pair of left hand and right hand workman's gloves 10 and 12. Each of the gloves, such as 12, is made of a sheath of material, for example leather. Each glove has forward digit enclosing portions 14, a rearward wrist encircling portion 16, and an intermediate portion 18 connecting the forward and rearward portions. When the glove is worn, each of the aforementioned portions has a front surface on the palm side 20 of the hand and a rear surface on the back side 22 of the hand.

Figure 2:
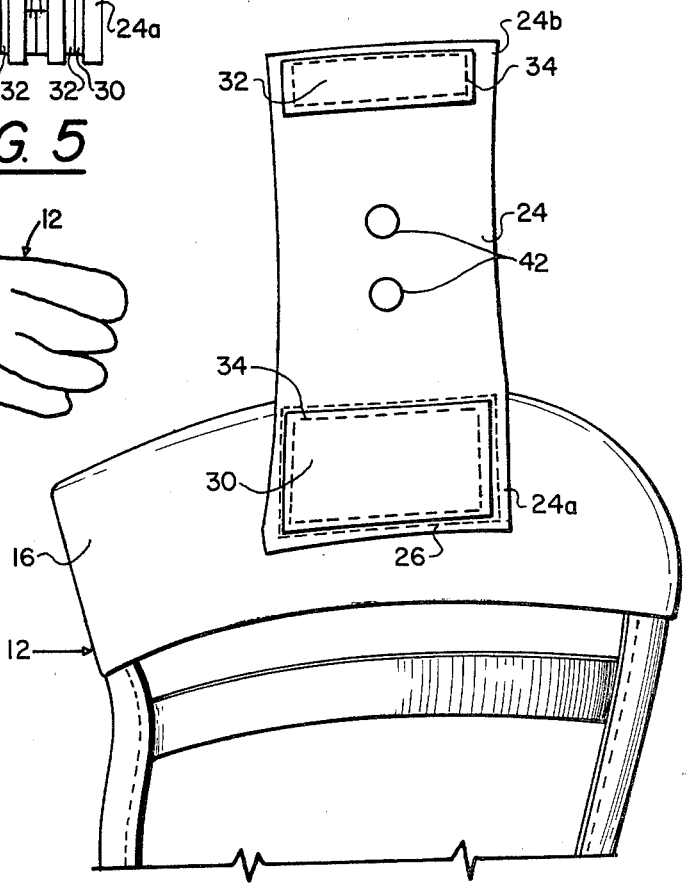
FIG. 2 is an enlarged view of a portion of one of the gloves of FIG. 1 illustrating the attachment mechanism thereof which includes a strip sewn to the cuff portion of the glove hook weave mating connecting surfaces attached to the ends of the strip.

As shown in FIG. 2, each glove, such as 12, has a strip 24 made of a flexible material, for example leather. As shown in FIGS. 1 and 2, a first end **24*a* of the strip is secured to the rear surface of the wrist circling portion 16 in a permanent manner such as by utilizing stitching 26 (FIG. 2). The strip 24 extends rearwardly from the wrist encircling portion 16 a distance sufficient to enable it to encircle a workman's belt 28 as shown in FIG. 3**.

Each glove is provided with means for removably attaching the second end **24*b* of its strip to the wrist encircling portion 16. As shown in FIG. 2**, the removable attachment means comprises a pair of mating hook weave connecting surfaces 30 and 32. These surfaces may be made of a material such as that sold under the trademark VELCRO. One of the surfaces 30 is secured to the exposed side of the first end 24*a* of the strip. The other one of the surfaces 32 is secured to the other end 24*b* of the strip on the same side thereof. The surfaces 30 and 32 may be secured to the strip by any suitable means such as by stitching 34. The strip 24 may be folded away from the wrist encircling portion 16 of the glove into a loop which surrounds the workman's belt 28 as shown in FIG. 3. The mating surfaces 30 and 32 may then be pressed together and will thereafter remain attached. The glove will then be secured to the workman's belt. The glove can be readily removed from the workman's belt by manually pulling the connecting surface 32 away from the surface 30 (FIG. 2).

Figure 3:
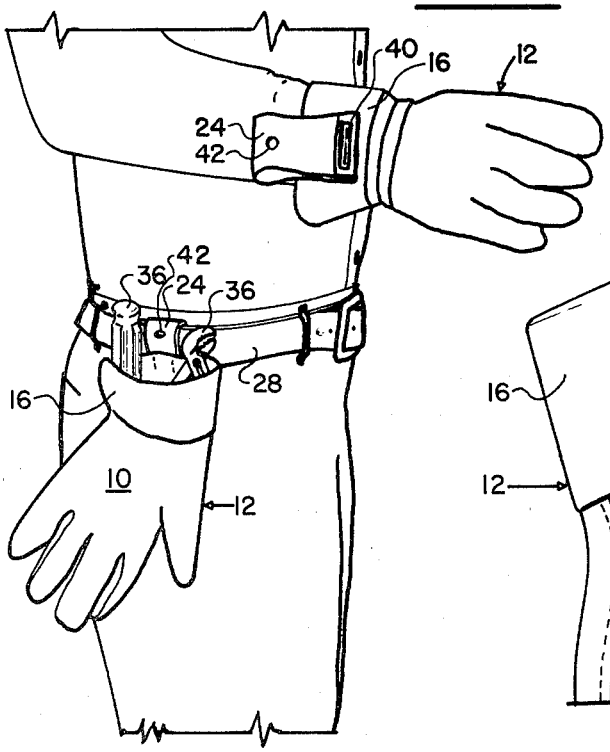
FIG. 3 illustrates the manner in which one of the gloves of FIG. 1 may be removably attached to a workman's belt so that a plurality of tools can be placed inside the glove in the manner of a tool pouch.

Preferably, the rearward wrist encircling portion 16 of each glove sheath comprises a flared cuff as shown in FIG. 3. When a glove is attached to the workman's belt, a plurality of hand tools 36 can be inserted inside of the glove which will function as a tool pouch.

Figure 4:
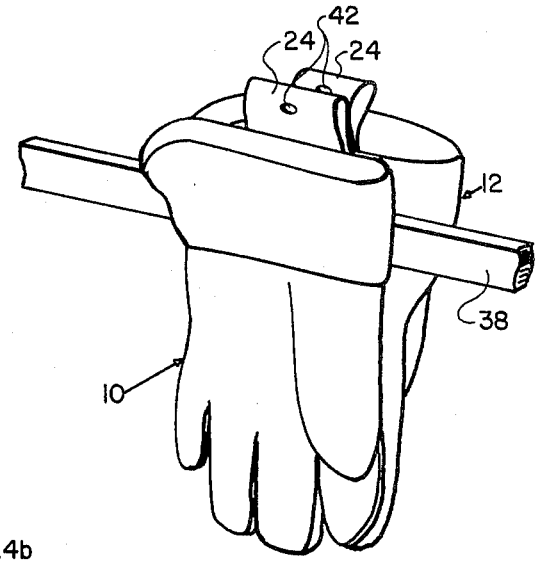
FIG. 4 illustrates the manner in which the connected gloves of FIG. 1 may be readily hung over a supporting member adjacent the work area.
Figure 5:
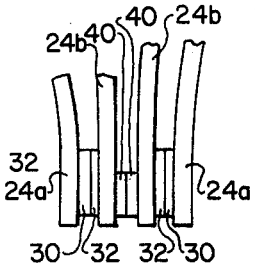
FIG. 5 is an enlarged fragmentary view illustrating the dimensional relationship of the hook weave mating connecting surfaces of the pair of gloves of FIG. 1 which permit the gloves to be connected to one another while permitting the gloves to be pulled apart without disconnecting the looped strips from their corresponding gloves.

The gloves of the present invention are further provided with means for releasably connecting them to one another as shown in FIG. 1. This permits them to be hung over a supporting member 38 (FIG. 4) or a fence, ladder, pipe, or the like near the work area. Thus, the gloves are always conveniently available for use and the likelihood of one glove losing its mate is considerably reduced. Alternatively, each of the gloves can be attached to the workman's belt on either side of his body so that they will always be conveniently available. Each glove is provided with a third hook weave mating connecting surface 40 (FIGS. 3 and 5). Each of the connecting surfaces 40 is secured to the end 24*b* of one of the strips on the side thereof opposite from its connecting surface 32 (FIGS. 2 and 5). The connecting surfaces 40 on each of the gloves are of different types so that they mate. In other words, one of the connecting surfaces 40 has the hooks on it and the other one of the connecting surfaces 40 has the loops of thread on it, i.e., the fuzzy side. Thus, when each of the gloves has its strip 24 folded into a loop as shown in FIG. 1 with its pair of connecting surfaces 30 and 32 mated, the rear surfaces of the gloves can be brought together and the connecting surfaces 40 pressed against each other. The gloves will thereafter remain connected together and can be hung over a supporting member such as 38 as shown in FIG. 4. The gloves can be readily separated merely by pulling them apart so that the connecting surfaces 40 release or tear away from one another.

It is desirable that when the gloves are torn away from each other from their connected relationship shown in FIG. 1, that each of the loops 24 remain intact. This will permit a workman to thread his or her belt through the loops when putting on the belt. It will also keep the strips from dangling and becoming a nuisance or a hazard as would otherwise occur if the ends 24*b* of the strips became disconnected from the wrist encircling portion and were free to flop about. By having the loops remain intact when the gloves are pulled apart from their connecting relationship as shown in FIG. 1, the workman does not have to reconnect each pair of connecting surfaces 30 and 32 to prevent them from dangling during use of the gloves.

In order to accomplish the foregoing objective, preferably the total area of engagement between the pair of connecting surfaces 40 is sufficiently smaller than the area of engagement between the connecting surfaces 30 and 32 on either glove. Then when the gloves are pulled apart from their positions shown in FIG. 1, the connecting surfaces 40 will tear away from each other before there is sufficient force for either of the pairs of connecting surfaces 30 and 32 to tear away from each other. It should be borne in mind, however, that the area of engagement between each pair of the connecting surfaces 30 and 32 must be sufficient so that when they are connected, the weight of the glove and the tools will be insufficient to tear them apart from one another. Furthermore, the area of engagement with the connecting surfaces 40 must be sufficient so that the combined weight of the pair of gloves will be insufficient to tear the surfaces 40 away from each other. This allows the gloves to be hung over a supporting member such as 38 (FIG. 4). FIG. 5 illustrates a dimensional relationship between the various connecting surfaces that will permit the glove to be disconnected from one another without disconnecting the loops.

Finally, each of the strips 24 may be provided with a pair of holes 42 (FIG. 2) in the middle portion thereof. These holes are positioned so that they are aligned when the strip is folded over and secured to the cuff as shown in FIG. 4. The gloves may thus be stored on a nail or similar element by sliding the hook through the aligned holes. The gloves may also be displayed in stores by sliding the strips over support hooks or rods which may extend through the holes 42. Conventional gloves must have a folded flap of cardboard or stiff paper stapled to them which is hung on a hook. The holes 42 may be cut in the straps by the same dies that cut them during manufacture.

Having described a preferred embodiment of the work gloves with attachment mechanism, it should be apparent to those skilled in the art that my invention permits of modification in both arrangement and detail. For example, the hook weave mating connecting surfaces could be replaced with button type snaps, or other suitable connecting mechanisms. Therefore, the protection afforded my invention should be limited only in accordance with the scope of the following claims.

I claim:

1. A pair of gloves, comprising:

first and second hand receiving sheaths, each having a rearward wrist encircling portion having a front surface on the palm side and a rear surface on the back side;

a pair of strips made of a flexible material, each having a first end secured intermediate the rear surface of the wrist encircling portion of a corresponding one of the sheaths and extending rearwardly therefrom a distance sufficient to encircle a workman's belt, each strip further having a width at least one-third the width of the wrist encircling portion;

a first pair of mating hook weave connecting surfaces, one surface of the first pair being secured to the first end of a first one of the strips on the exposed first side of the first strip and the second one of the surfaces of the first pair being secured to the second end of the first strip on the first side thereof to permit mating connection of the first and second surfaces of the first pair when the first strip is folded away from the wrist encircling portion to which the first strip is secured to thereby form a loop;

a second pair of mating hook weave connecting surfaces, one surface of the second pair being secured to the first end of the second one of the strips on the exposed first side of the second strip and the second one of the surfaces of the second pair being secured to the second end of the second strip on the first side thereof to permit mating connection of the first and second surfaces of the second pair when the second strip is folded away from the wrist encircling portion to which it is secured to thereby form a loop; and a third pair of mating hook weave connecting surfaces, one surface of the third pair being connected to the second end of the first strip on the second side thereof and the second surface of the third pair being connected to the second end of the second strip on the second side thereof;

whereby when the first pair of hook weave surfaces are connected and the second pair of hook weave surfaces are connected, the third pair of hook weave surfaces may be connected to removably hold the sheaths together.

2. A pair of gloves according to claim 1 wherein the areas of the third pair of hook weave surfaces are sufficiently smaller than the areas of the first and second pairs of hook weave surfaces so that the sheaths can be pulled apart to disconnect the third pair of hook weave surfaces without disconnecting the first and second pairs of hook weave surfaces.

* * * * *